United States Patent [19]

Hogeland

[11] Patent Number: 4,722,480

[45] Date of Patent: Feb. 2, 1988

[54] DISCHARGE DEVICES FOR RAINWATER DOWNSPOUTS

[75] Inventor: Vernon C. Hogeland, Barefoot Bay, Fla.

[73] Assignee: Vermar Corporation, Barefoot Bay, Fla.

[21] Appl. No.: 822,248

[22] Filed: Jan. 24, 1986

[51] Int. Cl.[4] ..... B05B 15/02; B05B 15/10; B05B 1/14

[52] U.S. Cl. ..... 239/208; 239/110; 239/553.3; 239/559

[58] Field of Search ..... 239/110, 208, 553, 556, 239/558, 559; 52/12, 16

[56] References Cited

U.S. PATENT DOCUMENTS

| | | | |
|---|---|---|---|
| 530,868 | 12/1894 | Weed | 239/559 |
| 634,899 | 10/1899 | Miller | 239/559 X |
| 2,776,861 | 1/1957 | Swenson | 239/208 |
| 3,904,121 | 9/1975 | Geagan | 239/208 |

*Primary Examiner*—Andres Kashnikow
*Assistant Examiner*—Patrick N. Burkhart
*Attorney, Agent, or Firm*—Edward M. Livingston

[57] ABSTRACT

Improved water discharge devices mountable on the bottom of standard downspouts. The front of the devices contain holes through which water is discharged while the back or interior of the devices certain slanted or angled surfaces which act to increase the water pressure by deflecting and directing water out the holes for wider distribution over the ground without gouging caused by standard downspouts. A slidably raisable back door is provided at the bottom of the device for removing debris from the devices if necessary. A declogging section which is mounted upstream of the discharge device, consisting of a screen and a deflector plate, removes leaves and other debris from rainwater passing through the downspout before such debris reaches the bottom discharge devices.

2 Claims, 8 Drawing Figures

DISCHARGE DEVICES FOR RAINWATER DOWNSPOUTS

BACKGROUND OF THE INVENTION

This invention relates to the distribution and use of rainwater from downspouts and more particularly to discharge devices for said downspouts.

The standard downspout in use on residential and commercial buildings consists of an elbow-like extension which is fully open at the discharge end. Rain water running off from the roofs of such buildings, which can be quite substantial and very rapid during heavy rainstorms, rushes out the open ends of these downspouts often resulting in holes being gouged in the ground under and around the downspout. Furthermore, the water which runs off in this fashion is wasted and serves no useful purpose, such as the watering of plants, shrubs or grass. Another problem with current downspouts is that in an effort to prevent such gouging, downspouts are placed close to the ground, thereby interferring with lawn maintenance. Furthermore, in an effort to prevent such gouging, unsightly sand pits, boards or concrete run off pads are placed under the downspouts.

Attempts to solve these problems have been made in prior patented art. For instance, U.S. Pat. No. 3,904,121 by Geagan discloses an elbow-shaped downspout extension which is closed at the end and has holes in the sides and tops for water discharge. Unfortunately, this device was designed in such manner that not enough pressure is created to force the water out and sprinkle it over a wide area from the extension. Therefore, the Geagan device must also rely on hoses in order to spread the water. Furthermore no provision is made for de-clogging the device during or after its operation. Additionally, this device extends outward from the vertical downspout just like standard open elbow extension and consequently interferes with lawn maintenance.

U.S. Pat. Nos. 3,035,779 by Convis; 3,966,121 by Littman and 2,814,529 by Arnt show hose-like downspout extensions designed to deliver roof rainwater run off away from the downspout. These devices rely on hoses to spread the water and still interfere with lawn maintenance.

Another attempt to solve the problems associated with rainwater run off is illustrated in U.S. Pat. No. 2,776,861 by Swenson which shows a defuser that delivers rainwater from the horizontal gutter along the roof to the ground below. However, this device does little to solve the problems of run off from the downspout itself.

The above patents are representative of what is in the art. Unfortunately, none of these devices fully resolves the problems associated with rain water discharge from downspouts. These problems, which the instant invention resolves, are interference with lawn cleaning operations because the instant device can be placed well off the ground higher on the downspout. Another problem with the prior devices is that not enough pressure is created for adequate spraying of the water. The instant invention resolves this problem by providing a slanted surface on the exterior back or in the interior of the device which deflects and directs the water coming down the downspout toward and through the small holes in the front of the device. Another problem with the prior art is that hoses are required to help distribute the water from the downspout. On the other hand, the instant invention does not require any hoses to be used in conjunction therewith since it adequately spreads the water without the use of hoses. A further problem with prior devices is clogging with leaves and other debris which blocks the distribution of water. The instant device resolves this problem by providing a slidably raisable door for cleaning located in the bottom of the back surface to which there can be added a de-clogging action placed upstream of the discharge device.

In summary, the instant application provides numerous improvements in discharge devices for rainwater downspouts. These discharge devices contain holes in the front thereof for out-flow with slanted metal or plastic interior angles to increase out-flow pressure. Also, the improvements contain a back door for cleaning debris, as well as a section to be installed separately or as part of the normal downspout upstream of the discharge end, which discharges leaves and other debris before it even reaches the discharge end.

SUMMARY OF THE INVENTION

The object of this invention is to provide an improved device for discharging rainwater from downspouts which will distribute and make better use of the water, while eliminating gouging of the ground caused by rapidly dispersed water.

A second object of the invention is to provide the water flow discharge devices which are free of leaves and other debris which would otherwise affect the run off.

Another object of the device is to provide discharge devices which are mountable on normal downspouts and which do not interfere with lawn maintenance and do not have to be removed for proper lawn care.

An even further object of the invention is to provide a device which has sufficient pressure at the discharge end to spray the water over a wide area of the yard.

A further object of the invention is to perform all of the above objects and at the same time be easy to install, use and aesthetically pleasing.

The instant invention fulfills these and other objects by providing water discharge devices which are easily mountable to regular downspouts with no change to regular downspouts. One embodiment of the invention can even be placed over the elbow extension on downspouts as is. The instant devices prevent gouging of the yard under the downspouts discharging the rainwater from holes in the front portion of the devices rather than out the bottom which is completely enclosed and sealed in the case of the instant device. A slanted back surface or surface in the interior of the device increases water a pressure through said holes by deflecting and directing the water running through the downspouts towards the holes. The design of the holes, larger at the top gradually decreasing to smaller holes at the bottom, thereby further increases the distribution of water over a wider area of ground.

Since gouging of the ground is not a concern as it is with normal downspouts the instant device can be placed higher on the downspout, thereby keeping the area clear for lawn motors and grass trimmers which makes lawn maintenance easier. The objective of keeping the downspout free of leaves and debris is accomplished by providing a slidably raisable door on the bottom of the back of the discharge device. Also, for cleaning purposes a de-clogging section to be inserted separately or as part of the downspout upstream of the discharge device is provided herein. This de-clogging section utilizes a slanted screen and deflector to remove leaves and debris. If improvements are not sufficient additional cleaning could be accomplished also by merely pulling off the discharge end and shaking out the debris.

The instant discharge device can be made of metal, such as aluminum, or plastic of the same color as the wall behind the downspout so as to blend in with downspouts already installed. Furthermore, the instant devices make sand or concrete runoff pads unnecessary which further reduces the unsightliness normally associated with downspouts.

Thus the instant invention provides a gentle sprinkling distribution of rainwater which can be used for watering flower gardens and the like planted below or around the downspouts.

BRIEF DESCRIPTION OF THE DRAWINGS

The drawings which illustrate the embodiments of the instant invention are as follows.

DESCRIPTION OF THE PREFERRED EMBODIMENTS

Figure 1:
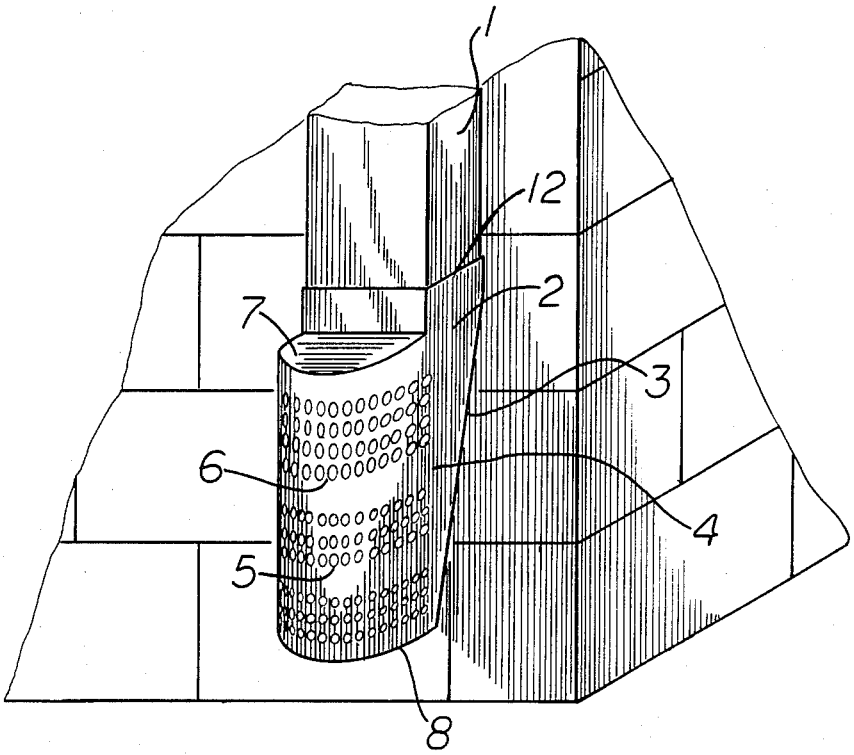
FIG. 1 is a perspective view of a discharge device in operation.
Figure 2:
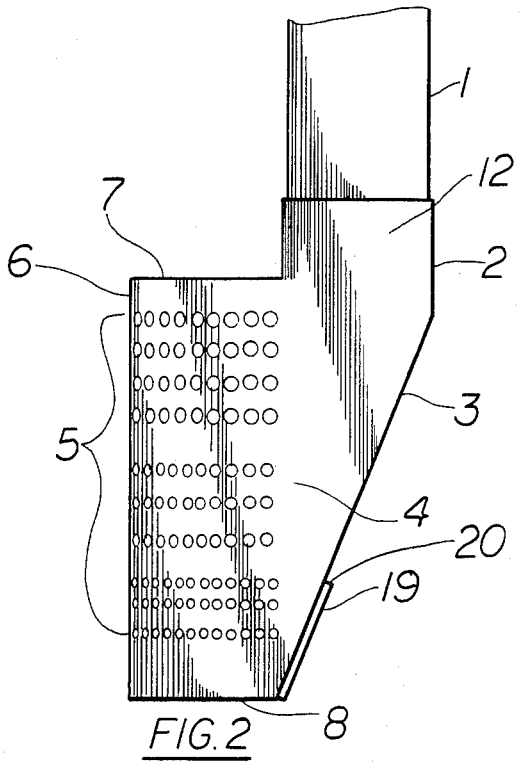
FIG. 2 is a side view of the device of FIG. 1.

By referring to the drawings the instant invention will now be described in detail. FIGS. 1 and 2 show one embodiment of the device, generally indicated by numeral 2, which is designed to be mounted at the bottom of the downspout 1 in place of the standard downspout elbow extension by sliding onto the downspout 1 with a telescopic like sleeve 12. This device 2 can be additionally secured to the downspout 1 by screws or bolts inserted in the sides 4, although not necessary and not shown in the drawings. This device 2 could also be manufactured as part of the downspout 1 itself especially before downspouts are installed on new buildings.

Below the connecting sleeve 12 of the device 2 is a back section 3 which is angled or slanted toward the front from the top to bottom and a front section 6. The back section 3 is sharply slanted towards the front at varying angles anywhere from 45 to 60 degrees so as to deflect and direct the rainwater toward the front section 6 and out the holes 5 on the front section 6 and the sides 4. Contrary to normal elbow-shaped downspout extensions which have are open as the bottom 8 of the instant device 2 is sealed, thereby preventing the water from gouging the ground around the downspout. The top 7 of the front section 6 is sealed and has no holes. The discharge holes 5 on the front section 6 perform better if they are larger at the top and gradually decrease in size to the bottom. This gradual decrease in size increases the water pressure through the holes 5 and distributes the water over a wider area around the downspout.

In the instant device a cleaning door section 19 can also be provided to help remove leaves and other debris after rainstorms. The door 19 can be raised by pulling the lid 20 upward, and closed after cleaning by sliding the door down between two sleeves on the back portion 3 of the device 2.

Figure 3:
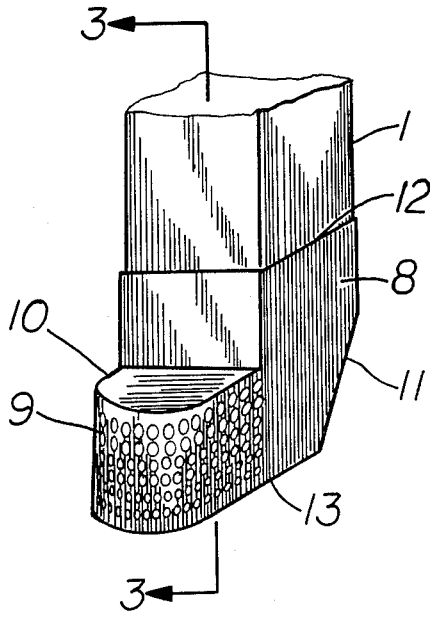
FIG. 3 is a perspective view of a second embodiment of the discharge device.
Figure 4:
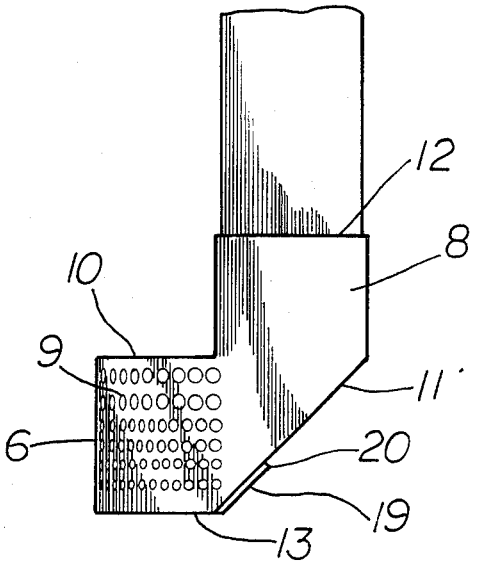
FIG. 4 is a side cut-away view of the device of FIG. 3 along line 3—3.

A second embodiment, which is somewhat similar to the first described above, is shown in FIGS. 3 and 4. This embodiment of the device, generally indicated by the number 8, is mounted in place of the standard elbow-shaped downspout extension or directly on the elbow itself. This embodiment has a smaller front section 6 than the device shown in FIGS. 1 and 2, but has a more sharply slanted back section 11 to increase the water pressure through the holes 9 in the front of the device 8, thereby dispersing the water over a large area. As with the prior embodiment of the device 2, this embodiment 8 can be cleaned through a door 19 on the back surface 11 or by merely pulling off the device 8, turning it upside down and shaking out any leaves or debris.

Figure 5:
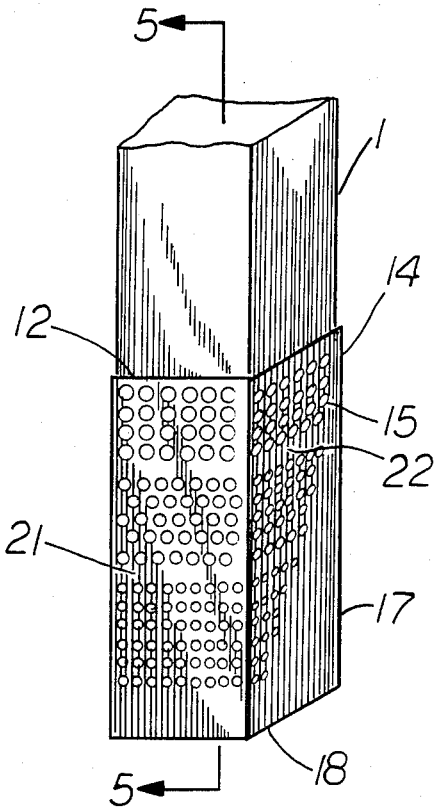
FIG. 5 is a perspective view of a third embodiment of the discharge device.
Figure 6:
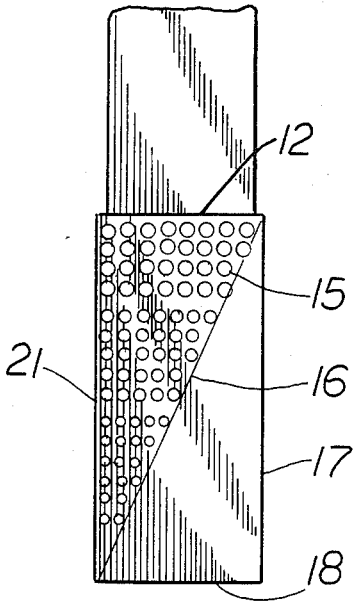
FIG. 6 is a side cut-away view of the device of FIG. 5 along line 5—5.

A third embodiment of the discharge device for downspouts is shown in FIGS. 5 and 6 and is generally indicated by numeral 14. This device 14 is mounted on the end of the straight portion of the downspout 1 by telescopic sleeve 12. The exterior of the device 14 is rectangularly shaped like the downspout and has holes 15 on the front 21 and on the sides 22. Said holes 15 on the sides 22 are positioned diagonally from the top of the back to the bottom of the front 21 of the device 24. The diagonal arrangement of the holes 15 is necessary because the interior of the device 14 contains an angular/slanted surface 16 shown in the cut-away view of FIG. 6. This surface 16 extends between the two sides and slanted from the back 17 to the front 21 and, as with the prior embodiments, directs and forces the rainwater out of the front 21 of the device 14.

Figure 7:
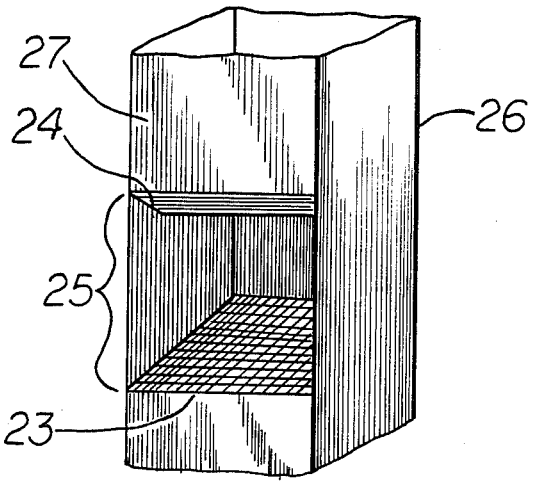
FIG. 7 is a perspective view of the de-clogging device for downspouts.
Figure 8:
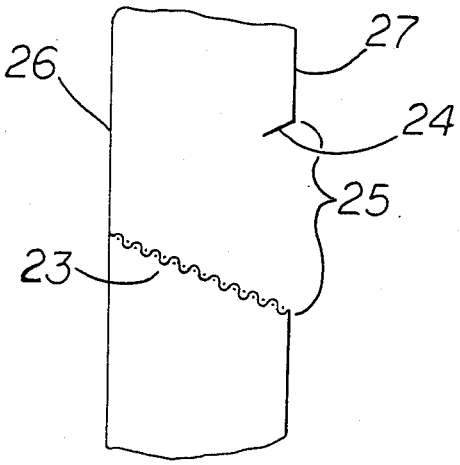
FIG. 8 is a side cut-away view of the de-clogging section along line 7—7 of FIG. 7.

The final improvement regarding rainwater downspouts is the device shown in FIGS. 7 and 8. This device was designed to be used in conjunction with the discharge devices in FIGS. 1 through 6 for the purpose of de-clogging said discharge devices, which are more susceptible to blockage from debris and leaves from rain water run off since they are sealed at the bottom. This section is designed to be installed upstream of the discharge ends either separately into the downspout 1 or to be manufactured as part of the downspout. This de-clogging section is the same shape and size of the downspout 1. In operation, leaves and other debris in the rainwater is discharged out an opening 25 in the front 27 of the section after being caught by a screened or grated portion 23. The water passes through the screen or grated portion 23, which is slanted downward from the back of the downspout 26 to the bottom of the front opening 25. The screened or grated portion 23, which is made preferably of fine screen, prevents such debris from reaching the discharge ends and possibly clogging or blocking the holes contained therein. A further feature of this de-clogging section, which prevents most of the rainwater from passing out the opening 25, is a deflector 24 which is attached to the top of the front opening 25 and slants inwardly and downwardly from the front 27. Any rainwater which may have otherwise passed out the opening 25, hits the deflector 24 and falls back through the screen 23 and down the downspout to the discharge end.

In summary, the instant invention shows numerous improved devices for discharging rain water from downspouts. These devices eliminate the gouging caused by water run off from normal downspouts and instead gently sprinkles the water over a wide area of ground. Also, these devices by use of a unique interior or exterior angular portion increases the water pressure out of the holes in the front for wider distribution over the surrounding grounds. Further, to keep the discharge devices from becoming clogged and the holes blocked, a cleaning door is provided on the back of the devices. Also, provided herein is a de-clogging section which can be installed upstream of the discharge devices. These devices can be made of either metal, such as aluminum, or plastic and of many different colors to blend in with the wall behind the downspout. The devices are simple to install on the bottom of current downspouts or can be manufactured as part of the downspout itself. Moreover, these discharge devices eliminate the sand or concrete runoffs needed for normal downspouts to prevent gouging. Also these devices make lawn maintenance around downspouts easier and allow flowers or other beautifying plants to be planted around downspouts.

The foregoing embodiments as illustrated and described hereinabove are not intended to limit the scope of the invention. Further modifications and changes may be made which are intended to fall within the scope of the appended claims.

I hereby claim the following:

1. A discharge device for water downspouts comprising an extension mountable on the end of a downspout said extension having four surfaces, the back and bottom surfaces being enclosed, the two side surfaces containing holes running diagonally from top of the back to the bottom of the front of said side surfaces and a front surface having holes from the top to the bottom, said extension also having a flat surface in the interior which slopes from the back surface at the top of said extension to the front surface at the bottom of the extension.

2. The discharge device of claim 1 in which the holes on the front surface gradually decrease in size from the top to the bottom of the extension.

* * * * *